United States Patent [19]

Dellinger

[11] Patent Number: 4,754,819

[45] Date of Patent: Jul. 5, 1988

[54] METHOD FOR IMPROVING CUTTINGS TRANSPORT DURING THE ROTARY DRILLING OF A WELLBORE

[75] Inventor: Thomas B. Dellinger, Duncanville, Tex.

[73] Assignee: Mobil Oil Corporation, New York, N.Y.

[21] Appl. No.: 24,442

[22] Filed: Mar. 11, 1987

[51] Int. Cl.[4] ..... E21B 7/08; E21B 17/02

[52] U.S. Cl. ..... 175/61; 175/325

[58] Field of Search ..... 175/61, 62, 65, 321, 175/325

[56] References Cited

U.S. PATENT DOCUMENTS

| | | | |
|---|---|---|---|
| 4,246,975 | 1/1981 | Dellinger | 175/325 X |
| 4,361,193 | 11/1982 | Gravley | 175/61 |
| 4,368,787 | 1/1983 | Messenger | 175/319 |
| 4,373,592 | 2/1983 | Dellinger et al. | 175/61 |
| 4,428,441 | 1/1984 | Dellinger | 175/325 X |
| 4,552,230 | 11/1985 | Anderson et al. | 175/321 |
| 4,646,855 | 3/1987 | Dellinger | 175/61 |

FOREIGN PATENT DOCUMENTS

| | | | |
|---|---|---|---|
| 0184304 | 6/1986 | European Pat. Off. | 175/61 |

*Primary Examiner*—George A. Suchfield
*Attorney, Agent, or Firm*—Alexander J. McKillop; Michael G. Gilman; George W. Hager, Jr.

[57] ABSTRACT

A wellbore drill string is formed of a plurality of sections of drill pipe interconnected at tool joints with a drill bit at its lower end. A drilling fluid is circulated down the drill string and up the annulus between the wellbore and the drill string. A plurality of annulus reducers located at spaced-apart positions along the drill string impart a cyclical pumping action to the flowing drilling fluid. During drilling, the drill string is axially reciprocated and an extension capability to the drill string maintains continuous weight on the drill bit.

2 Claims, 3 Drawing Sheets

METHOD FOR IMPROVING CUTTINGS TRANSPORT DURING THE ROTARY DRILLING OF A WELLBORE

BACKGROUND OF THE INVENTION

In the drilling of wells into the earth by rotary drilling techniques, a drill bit is attached to a drill string, lowered into a well, and rotated in contact with the earth; thereby breaking and fracturing the earth and forming a wellbore thereinto. A drilling fluid is circulated down the drill string and through nozzles provided in the drill bit to the bottom of the wellbore and thence upward through the annular space formed between the drill string and the wall of the wellbore. The drilling fluid serves many purposes including cooling the bit, supplying hydrostatic pressure upon the formations penetrated by the wellbore to prevent fluids existing under pressure therein from flowing into the wellbore, reducing torque and drag between the drill string and the wellbore, maintaining the stability of open hole (uncased) intervals, and sealing pores and openings penetrated by the bit. A most important function is hole cleaning (carrying capacity), i.e. the removal of drill solids (cuttings) beneath the bit, and the transport of this material to the surface through the wellbore annulus.

Reduced bit life, slow penetration rate, bottom hole fill up during trips, stuck pipe, and lost circulation, can result when drill solids are inefficiently removed in the drilling of vertical boreholes. The efficiency of cuttings removal and transport becomes even more critical in drilling the deviated or inclined wellbore, particularly when the inclination is greater than 60 degrees, because as cuttings settle along the lower side of the wellbore, this accumulation results in the formation of a cutting bed. As a result of the reduction in net area open to flow, cuttings transport becomes severely impaired. If the drill pipe lies on the low side of an open hole interval (positive eccentricity), drill solids concentrate in the constricted space and conditions susceptible to differential sticking of the pipe can also occur. Hole cleaning can also be a problem under conditions where the drill string is in tension and intervals of negative eccentricity result as the drill string is pulled to the high side of the annulus. In the latter situation, the drill string is not usually in direct contact with the cuttings bed, but the latter's presence can lead to incidents of stuck pipe when circulation is stopped to pull out of the hole.

Various methods have been proposed for improving the efficiency of cuttings removal from the wellbore, including, promoting the formation of a particular flow regime throughout the annulus, altering the rheology of the entire drilling fluid volume, increasing the annular velocity, rotating pipe, and combinations thereof. In the case of the inclined wellbore, U.S. Pat. No, 4,246,975 to Dellinger, teaches the use of eccentric tool joints to stir up the cuttings bed, thus aiding cuttings removal.

U.S. Pat. No. 4,361,193 to Gravley teaches the incorporation of one or more fluid nozzles in the drill string for directing a portion of the drilling fluid circulating in the drill string outwardly into the annulus of the wellbore about the drill string so as to effect a stirring action on the drill cuttings and improve their removal by the return flow of the drilling fluid.

SUMMARY OF THE INVENTION

The present invention is directed to a method and system for increasing the cuttings transport efficiency during the rotary drilling of a wellbore. A drill string is formed of a plurality of sections of drill pipe interconnected at tool joints with a drill bit at its lower end. A drilling fluid is circulated down the drill and up the annulus between the wellbore and the drill string. As the drilling fluid is circulated, it flows through a plurality of annulus reducers located at spaced-apart positions along the drill string. The annulus reducers impart a cyclical pumping action to the flowing drilling fluid. During drilling, the drill string is axially reciprocated. An extension capability of the drill string maintains continuous weight on the drill bit during this reciprocating action.

In a further aspect, the annulus reducers provide for at least two differing sizes of annulus restrictions alternately spaced along the wellbore.

In a still further aspect, the reciprocating movement of the drill string is such that each annulus reducer is moved a distance at least equal to the axial spacing of the annulus reducers along the drill string.

DESCRIPTION OF THE PREFERRED EMBODIMENT

Figure 1:
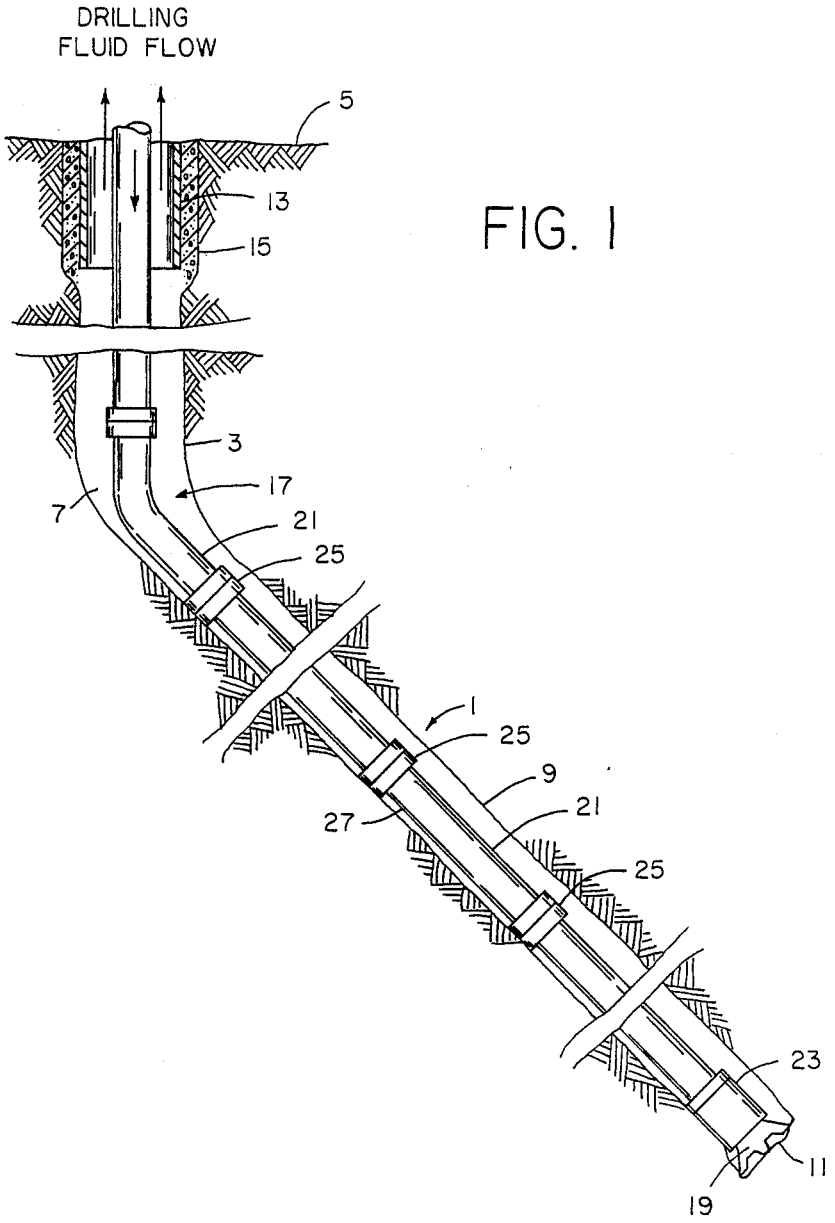
FIG. 1 illustrates a drill string lying along the lower side of a deviated wellbore extending into the earth.

Referring to FIG. 1 there is illustrated a conventional drill string used in the rotary drilling of a wellbore, particularly a deviated wellbore. A deviated wellbore 1 has a vertical first portion 3 which extends from the surface 5 of the earth to a kick-off point 7 and a deviated second portion 9 of the wellbore which extends from the kick-off point 7 to the wellbore bottom 11. Although the illustrated embodiment shows a wellbore having a first vertical section extending to a kick-off point, the teachings of the present invention are applicable to other types of wellbores as well. For instance, under certain types of drilling conditions involving porous formations and large pressure differentials, the teachings herein may be applicable to vertical wellbores. Also some deviated wellbores need not have the first vertical section illustrated in FIG. 1.

A shallow or surface casing string 13 is shown in the wellbore surrounded by a cement sheath 15. A drill string 17, having a drill bit 19 at the lower end thereof, is positioned in the wellbore 1. The drill string 17 is comprised of drill pipe 21 and the drill bit 19, and will normally include at least one drill collar 23. The drill pipe 21 is comprised of joints of pipe that are interconnected together by tool joints 25, and the drill string may also include wear knots for their normal function. In the deviated second portion 9, the drill string normally rests on the lower side 27 of the wellbore.

Drill cuttings are removed from the wellbore bottom 11 by circulating drilling fluid, as shown by the arrows.

It is a common occurrence in the drilling of high-angle boreholes, as shown in FIG. 1, to have difficulty in removing the drill cuttings from the wellbore. A normal drilling mud circulation rate is about 100 feet/- minute average velocity in the annulus between a 5 inch drill pipe and a nominal 12¼ inch wellbore. This velocity is frequently inadequate to remove the drill cuttings. By increasing the mud flow velocity to 150 feet/minute, cuttings removal has been found to be enhanced. However, problems are experienced at the greater flow rate. Pump pressures increase dramatically causing added expenditure of power and maintenance. The wellbore may not be able to support this increased pressure without breakdown of the formation and subsequent loss of drilling mud circulation.

Also, any decrease in the size of the annulus will cause both a pressure and velocity increase in the drilling mud flow. For example, the mud flow velocity of 100 feet/minute around the 5 inch drill pipe will increase to about 115 feet/minute about a 6⅜ inch tool joint and to about 145 feet/minute about an 8 inch drill collar. In addition, if the 12¼ inch wellbore were reduced to 11¼ inch, the mud flow velocity would be about 123 feet/minute about the 5 inch drill pipe, 145 feet/minute about the 6⅜ inch tool joint and 198 feet/minute about the 8 inch drill collar. These velocity changes are even more pronounced in drilling a 9⅞ inch wellbore with 5-inch drill pipe.

Figure 2:
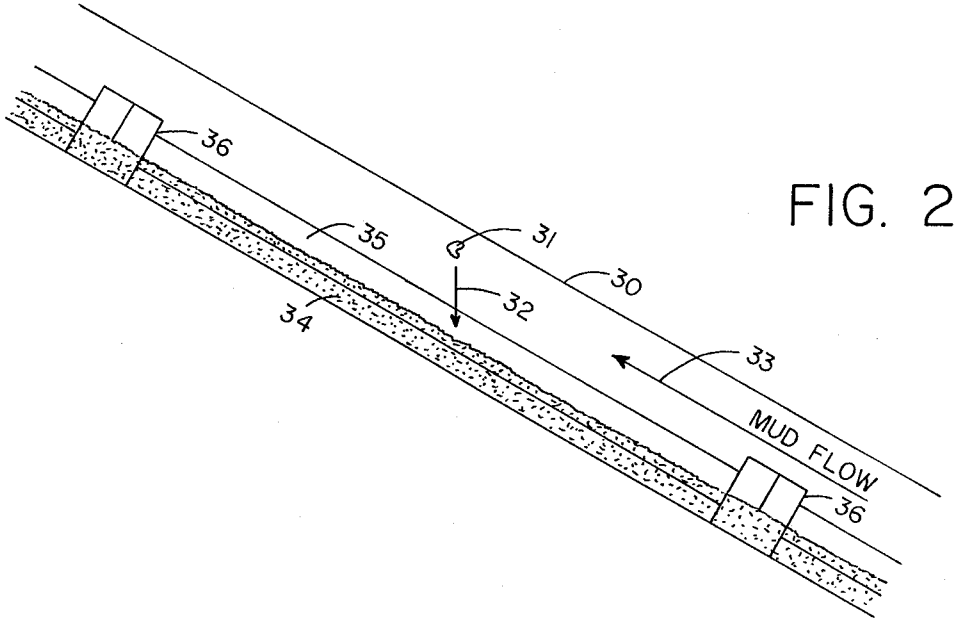
FIG. 2 illustrates a cuttings bed buildup around the drill string of FIG. 1 during rotary drilling operations.

To overcome such problems of drill cuttings removal in wellbore drilling operations, particularly in deviated wellbores, the present invention provides for the imparting of a cyclical pumping action into the drilling mud flow up the wellbore annulus. This pumping action provides a stirring of the cuttings which enhances their transport up the wellbore by the flowing drilling mud. This may be better understood by reference to FIGS. 2 and 3. Referring first to FIG. 2, it can be seen that in a deviated wellbore 30 each drill cutting particle 31 will tend to fall (as shown by arrow 32) from the flow of drilling mud up the wellbore (as shown by arrow 33). These particles accumulate on the lower side of the wellbore to form a cuttings bed as shown at 34 beneath and around the drill pipe 35 which also rests along the lower side of the wellbore on the tool joints 36.

Figure 3:
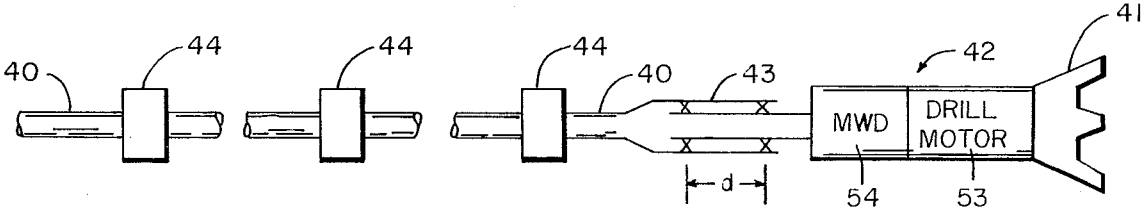
FIG. 3 illustrates the drill string of the present invention for use in the deviated wellbore of FIG. 1 to minimize a cuttings bed buildup.
Figure 6:
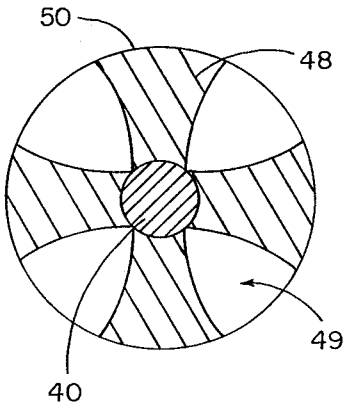
FIGS. 4–6 illustrate alternate embodiments for the annulus reducers utilized with the drill string of FIG. 3.
Figure 5:
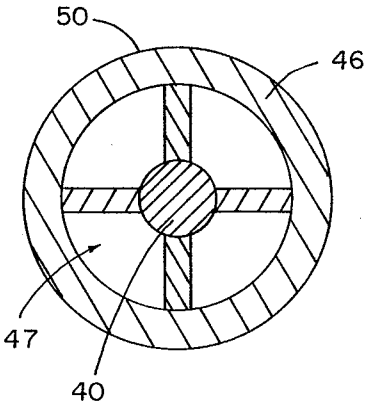
Figure 4:
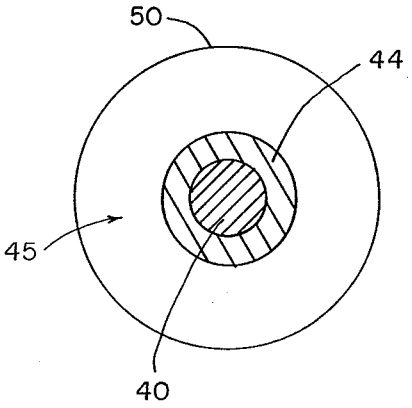

Referring now to FIG. 3 there is diagrammatically shown the drilling tool of the present invention, the use of which provides a stirring action to the drill cuttings to keep them from falling out of the mud flow stream. At the lower end of the drill pipe 40 is the drill bit 41 and a conventional bottom hole assembly (BHA) 42 including the drill motor 53 and the measuring while drilling system 54. Adjacent the bottom hole assembly 42 is shown the extension sub 43 which provides the immediate source of weight on the drill bit. The drill pipe 40 may be cyclically moved up and down in the wellbore, to the extent allowed by the extension sub, without taking weight off the drill bit. Located at spaced-apart positions along the drill pipe 40 are a plurality of annulus reducers 44. These annulus reducers may be all of the same type or may be of different types at select spaced-apart positions along the drill pipe. FIG. 4 illustrates an annulus reducer 44 that is a drill pipe diameter enhancer wherein the mud flow cross-sectional area is reduced to the area 45 within wellbore 50. FIG. 5 illustrates an annulus reducer 46 that is a wellbore diameter reducer wherein the mud flow cross-sectional area is reduced to the area 47 within the wellbore 50. FIG. 6 illustrates an annulus reducer 48 that is a conventional drill pipe stabilizer wherein the mud flow cross-sectional area is reduced to the area 49 within the wellbore 50.

The drill tool of FIG. 3 is used to provide the desired stirring action to the drill cuttings in the following manner. During drilling operations, the drill pipe is cyclically moved up and down in the wellbore a distance d as permitted by the extension sub 43 which continuously maintains weight on the drill bit to advance the drilling operations. As the drill pipe is moved up and down the distance d, the annulus reducers 44 are also moved up and down the same distance d. It is preferable that the spacing between these annulus reducers be no greater than the distance d so that the up or down position of any one of such reducers overlaps with the down or up position respectively of an adjacent reducer. In this configuration, each axial movement of the drill pipe up and down in the wellbore cyclically causes the adjacent moving reduced annuli to overlap. The greater mud flow velocity through these moving reduced annuli imparts cyclical pumping action to the cuttings along the wellbore where the reduced annuli are located, thereby resulting in an enhanced transportion of the drill cuttings from the wellbore to the surface of the earth. Each of these stabilizers are supplied for varying wellbore size.

In one example, drill bit 41 is a 12¼ inch bit. Drill motor 53 is 7¾ inch Delta 1000 mud motor supplied by Dyna-Drill Co. of Irvine, Calif., and which is 24½ feet in length. The measuring-while-drilling system 54 can be of the types supplied by the Anadrill/Schlumberger of Houston, Tex.; Gearhart Industries of Fort Worth, Tex.; Teleco Oil Field Services of Meriden, Conn.; or Exploration Logging of Sacramento, Calif., for example. Other suitable measuring-while-drilling systems are disclosed in U.S. Pat. Nos. 3,309,656, 3,739,331; 3,770,006; and 3,789,355. The spiral-bladed stabilizers 56 can be of the integral blade or non-magnetic integral blade type supplied by Norton Christensen, Inc. of Houston, Tex. or of the rig-replaceable sleeve type supplied by Drilco (Div. of Smith International) of Houston, Tex., for example.

Several alternative embodiments are available for configuration of the extension sub 43. When powered by hydraulic pressure, the teaching of U.S. Pat. No, 3,105,561 to Kellner for a hydraulic actuated drill collar may be utilized. The technology utilized in conventional bumper subs or jars for drilling and fishing operations may also be used. Numerous manufacturers supply such bumper subs or jars as listed in the *Composite Catalog of Oil Field Equipment and Services,* 36th Revision, 1984–85, published by World Oil, Houston, Texas. Such bumper subs include the lubricated bumper sub No. 746-23 of Baker Service Tools, the A-Z fishing bumper sub of A-Z International Tool Co., and the fishing bumper sub of Bowen and the ball bearing drive bumper jar of Driltrol as examples.

Several such annulus area reducers are supplied by Servco, Division of Smith International, Inc., Gardena, Calif., such as the sleeve-type stabilizer or the integral blade stabilizer.

Several types of annulus area reducers are available in the form of drill collar stabilizers, drill pipe stabilizers, integral blade stabilizers, sleeve stabilizers and spiral blade stabilizers. Numerous manufacturers supply such stabilizers as also listed in the *Composite Catalog of Oil Field Equipment and Services,* 36th Revision, 1984–85, published by World Oil, Houston, Texas. All of these stabilizers come in varying sizes for differing wellbore sizes. Such stabilizers include the clamp-on type stabilizer of Servco, a Division of Smith International, Inc., and the clamp-on and interchangeable sleeve stabilizers of SMF International, Paris, France as examples.

While a preferred embodiment of the invention has been described and illustrated, numerous modifications or alterations may be made without departing from the spirit and scope of the invention as set forth in the appended claims.

I claim:

1. A method for increasing the cuttings transport efficiency during the rotary drilling of a wellbore with a drill string formed of a plurality of sections of drill pipe interconnected at tool joints and having a drill bit at the lower end thereof, comprising:

(a) circulating a drilling fluid down the drill string and returning said fluid from the wellbore up the annulus formed between the drill string and the wellbore wall, (b) flowing said drilling fluid through a plurality of annulus reducers successively varying in diameter and located at spaced apart positions along said drill string and (c) axially reciprocating said drill string a distance at least equal to the axial spacing of said variable diameter annulus reducers along said drill string during drilling while continuously maintaining drilling bit weight so as to provide a cyclical pumping action to the flow of drilling fluids in the axial direction of the wellbore which enhances the transport of drill cuttings up the annulus of the wellbore.

2. The method of claim 1 wherein the step of axially reciprocating said drill string is carried out such that positions of adjacent variable diameter annulus reducers at least overlap during each of said reciprocating movements.

* * * * *